United States Patent [19]

Wechsler et al.

[11] 4,204,948

[45] May 27, 1980

[54] SELF-PURGING SEAL

[75] Inventors: Ionel Wechsler, Framingham; John A. Oberteuffer, Lexington; John J. Nolan, W. Wareham; Henry H. Kolm, Wayland; Eric Georgelis, Hyde Park; Bo R. Arvidson, Acton, all of Mass.

[73] Assignee: Allis-Chalmers Corporation, Milwaukee, Wis.

[21] Appl. No.: 970,245

[22] Filed: Dec. 18, 1978

[51] Int. Cl.[2] ..... B03C 1/02

[52] U.S. Cl. ..... 209/223 R; 209/232; 277/165; 277/95

[58] Field of Search ..... 209/214, 222, 223 R, 209/232, 213; 210/222, 223; 277/207 R, 34, 34.3, 226, 165, 27, 95

[56] References Cited

U.S. PATENT DOCUMENTS

| | | | |
|---|---|---|---|
| 2,736,265 | 2/1956 | Higgins | 277/207 R X |
| 2,894,635 | 7/1959 | Irthum et al. | 277/34.3 X |
| 3,508,736 | 4/1970 | Rhodes et al. | 277/226 X |
| 4,052,310 | 10/1977 | Nolan | 210/222 |

FOREIGN PATENT DOCUMENTS

| | | | |
|---|---|---|---|
| 2254383 | 5/1973 | Fed. Rep. of Germany | 277/34 |

*Primary Examiner*—Ralph J. Hill
*Attorney, Agent, or Firm*—Lee H. Kaiser

[57] ABSTRACT

In a moving matrix magnetic separator in which a matrix device moves relative to a processing device and a seal assembly seals a longitudinal section of the matrix device to an associated processing device, the seal assembly including a sealing surface on one of the devices and a seal on the other, the improvement comprising said seal including a base portion extending generally longitudinally in the direction of motion of the matrix device; first and second salient, resilient lip portions extending from the base portion toward an associated sealing surface in the gap between the matrix device and the processing device, and extending generally longitudinally to the direction of motion of the matrix device and spaced from each other transversely to the direction of motion of the matrix device and forming a channel therebetween; a pressurized purge fluid chamber formed by the channel and the associated sealing surface; and means for supplying purging fluid to the purge fluid chamber formed by the channel and lip portions with the associated sealing surface.

12 Claims, 16 Drawing Figures

SELF-PURGING SEAL

FIELD OF INVENTION

This invention relates to an improved self-purging seal and more particularly to such a seal which forms a pressurized purge fluid chamber with its associated sealing surface.

BACKGROUND OF INVENTION

Sliding seals used in the handling of abrasive particles such as taconite present a serious wear problem. This problem is particularly severe in connection with magnetic separators because the stray magnetic fields and field gradients promote the accumulation of abrasive particles between the seal surfaces. In one application, U.S. Pat. No. 3,920,543, a filamentary ferromagnetic matrix material such as steel wool or expanded metal in a compartmented matrix device is carried through a processing device such as a feed station with a magnetic head where slurry is fed through the matrix and magnetic particles are retained in the matrix. Following this, the matrix is typically carried through a processing device such as a rinse station where less-magnetic particles are removed from the matrix. The matrix is then moved through a processing device such as a flush station where more-magnetic particles are removed from the matrix. In this operation it is important to prevent the entrapment of air at the feed station, and to minimize the leakage of slurry. Two sets of sliding seals are used: longitudinal seals along the edges of the matrix device and transverse seals between successive compartments. The transverse seals present relatively little problem, because they make intermittent contact with their bearing surfaces and thereby tend to purge accumulated particles. The longitudinal seals, on the other hand, make prolonged contact and may be subject to an internal overpressure which may be substantial at certain locations along their travel. Sealing systems which adequately perform the sealing function typically have a high wear rate, requiring frequent replacement of the flexible lips as well as the surfaces against which they bear. This wear problem adds significantly to the operating cost of these and other separators and may make them economically inapplicable to certain marginal processes.

SUMMARY OF INVENTION

It is an object of this invention to provide an improved self-purging seal for a magnetic separator which is simple, inexpensive, and easy to replace.

It is a further object of this invention to provide such a seal which promotes longer life of the seal and its sealing surface.

It is a further object of this invention to provide a self-purging chamber in conjunction with the sealing surface.

It is a further object of this invention to provide a self-purging seal which easily adapts to variations in gap height.

This invention results from the realization that a simple, inexpensive seal can be constructed using a pair of longitudinally extending transversely spaced lips which form between them, with the sealing surface, a self-purging chamber.

The invention features a self-purging seal assembly for use in a moving matrix magnetic separator in which a matrix device moves relative to a processing device such as a feeding or flushing station. The seal assembly includes a seal and a sealing surface. The seal can be fixed to the matrix device for sealing a longitudinal section of the matrix device to an associated sealing surface on the processing device or the seal can be fixed to the processing device and the sealing surface can be fixed to the matrix device. The improvement resides in the seal which includes a base portion which extends generally longitudinally to the direction of motion of the matrix device. There are first and second salient, resilient lip portions which extend from the base portion toward an associated sealing surface in the gap between the matrix device and processing device.

The lip portions extend generally longitudinally to the direction of motion of the matrix device and are spaced from each other transversely to the direction of motion of the matrix device. The lip portions form a channel between them; and a pressurized purge fluid chamber is formed by the channel and the associated sealing surface. There are means for supplying purging fluid to the purge fluid chamber formed by the channel and lip portions with the associated sealing surface.

The length of the seals extending in the gap between the matrix device and sealing surface is in one construction greater than the length of the gap between the matrix device and sealing surface. The base portion of the seal may be integral with the lip portions or separate and may be of the same material as the lip portions. In another construction, the base portion may include an inflatable passage which extends longitudinally therethrough with means for introducing thereto suitable pressure to control the contact pressure between the seal and the sealing surface. The means for supplying purging fluid to the self-purging chamber is preferably mounted to the stationary member, which is typically the processing device. Each lip portion may be chamfered to taper toward the sealing surface on its side facing away from the matrix device.

DISCLOSURE OR PREFERRED EMBODIMENT

Other objects, features and advantages will occur from the following description of a preferred embodiment and the accompanying drawings, in which.

Figure 1:
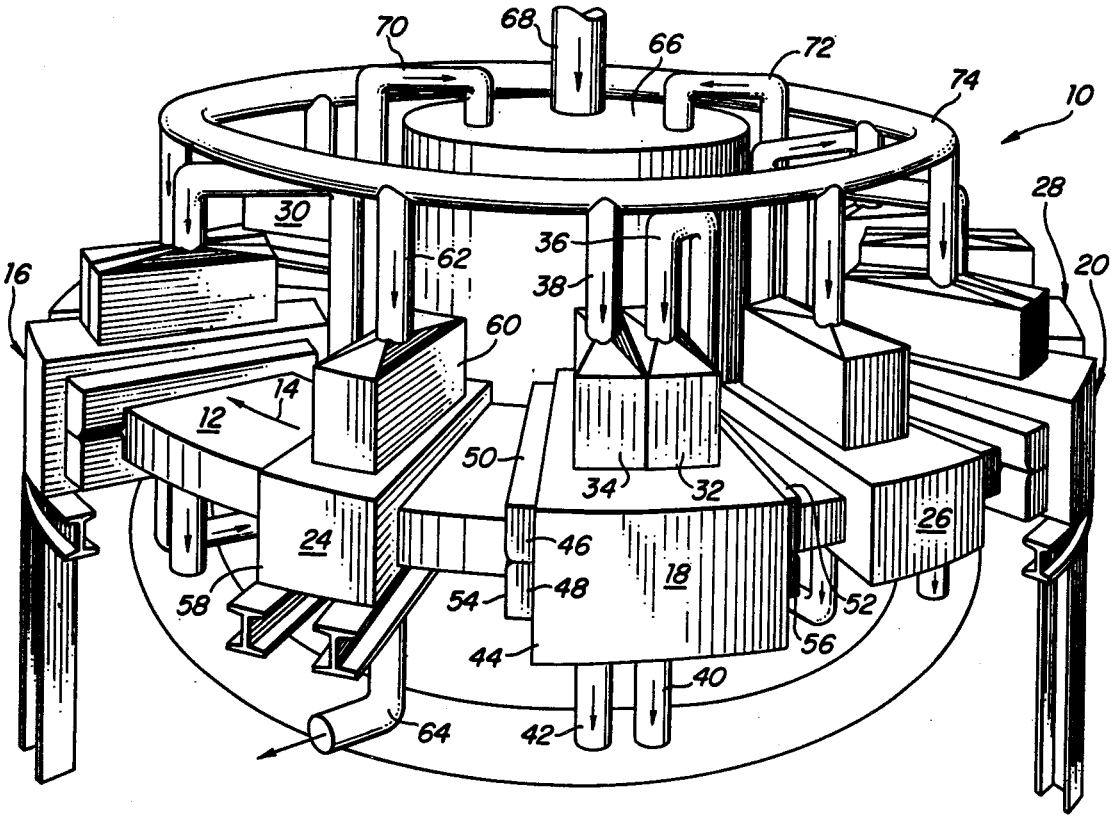
FIG. 1 is a schematic, axonometric view of a moving matrix magnetic separator which may use a self-purging seal according to this invention.

The invention may be accomplished in a moving matrix magnetic separator in which a matrix device moves relative to processing devices such as feed and flush stations. Generally the seals are on the moving matrix and the sealing surfaces are on the processing devices or stations, but the converse construction may also be used. A self-purging seal is employed for sealing a longitudinal section of the matrix device to an associated sealing surface. The seal itself includes a base portion which extends generally longitudinally to the direction of motion of the matrix device. The seal also includes first and second salient, resilient lip portions which extend from the base portion toward an associated sealing surface in the gap between the matrix device and processing device. The lip portions extend generally longitudinally to the direction of motion of the matrix device and are spaced from each other transversely to the direction of motion of the matrix device. The base portion and lip portions may be integral with each other and may be of the same material; for example, the seal could be a U-shaped rubber extrusion. Alternatively, the base may be integral with and of the same material as the matrix device and the lip portions alone may be of rubber. The base portion may be solid or hollow, and if hollow it may be connected to a pressurizing system so that this portion of the seal may be inflated or deflated as necessary to increase and decrease the sealing pressure that the seal exerts on the sealing surface. The lip portions form between them with the base portion a channel and the channel in conjunction with the associated sealing surface forms a pressurizable purge fluid chamber. There are means for supplying purging fluid to the purge fluid chamber formed by the channel and lip portions with the associated sealing surface.

The means for supplying the purging fluid is preferably mounted to the stationary member, typically the processing device or station, and thereby eliminates the problems of communication between a stationary source of supply and a moving member.

In one construction the length of the seal extending in the gap between the matrix device and sealing surface may be greater than the length of the gap itself, so that the lip portions of the seal are bent over. Preferably the seals are bent from the outside of the matrix device toward the inside so that any increase in pressure in the self-purging chamber causes the outer seal to seal more tightly against the sealing surface while causing the inner seal to seal more loosely so that the purging fluid can escape and purge abrasive particles from the sealing area into the matrix. To improve this facility each lip portion may be chamfered on its side facing away from the matrix device so that it tapers toward the sealing surface.

In another construction the lip portions are not required to bend over because the action of an inflatable base portion of the seal maintains proper contact pressure between the seal lips and the sealing surface, allowing for wear and mechanical imperfections that cause the distance between the sealing surface and the base portion of the seal to vary.

Periodically, the pressure of the self-purging fluid in the self-purging chamber may be increased to facilitate the escape of purging fluid. Such intermittent purging could be accomplished by simply periodically pulsing, that is increasing the pressure in the self-purging chamber, so that a spurt of purge fluid is released.

The purging fluid may be the same fluid as that in which the solids of the feed are suspended. For wet type magnetic separators, this is typically water; for dry type separators, typically dry air. In one construction the purging fluid may also serve to inflate the seal.

Figure 2:
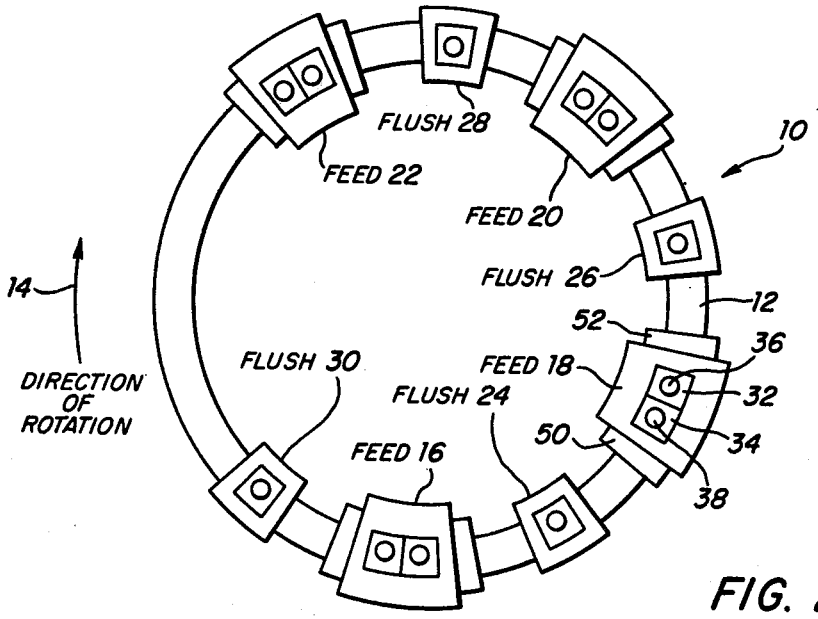
FIG. 2 is a diagrammatic plan view of the separator shown in FIG. 1.

The self-purging seal according to this invention may be used in a moving matrix magnetic separator 10, FIG. 1, which includes a horizontal matrix device 12 rotatable about its center in the direction of arrow 14 by drive means not shown. Spaced above the path of matrix device 12 are a plurality of processing devices or stations, feed stations 16, 18, 20, and 22, FIG. 2; and flush stations 24, 26, 28, and 30.

Figure 4:
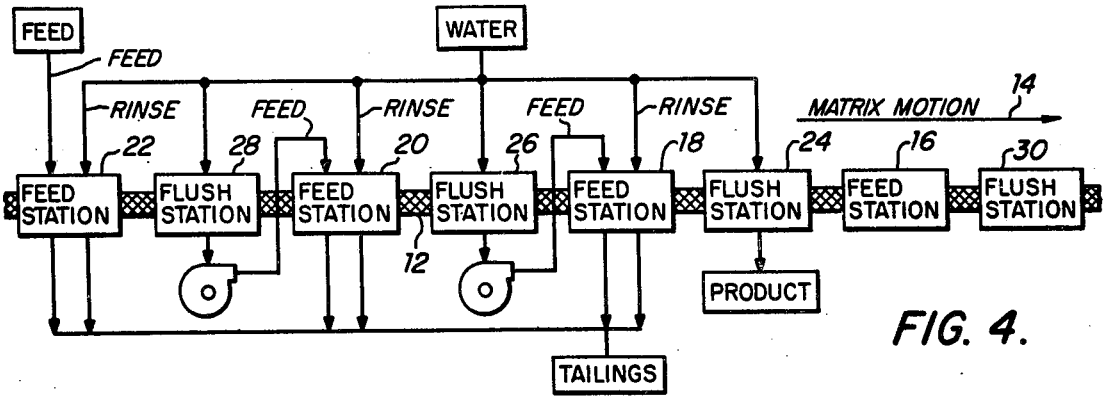
FIG. 4 is a schematic flow chart of one interconnection system which may be used with the separator of FIGS. 1 and 2.

Each feed station, exemplified by feed station 18, FIG. 1, includes a feed inlet 32 and a rinse inlet 34 which are fed by feed pipe 36 and rinse pipe 38, respectively, as well as a feed outlet 33 and rinse outlet pipe 42. Within housing 44, FIG. 1, is a split coil or a pair of coils 46 and 48 whose ends 50, 52 and 54, 56 are bent backwardly to provide apertures 120, 122, FIG. 3, at each end of housing 44 to permit the movement of matrix device 12 therethrough. Each flush station as exemplified by flush station 24, FIG. 1, includes a housing 58, FIG. 3, a flush inlet 60 connected to a flush inlet pipe 62, and a flush outlet 61, connected to a flush outlet pipe 64. Raw feed is supplied to feed inlet pipes which are connected to the feed reservoir 66, FIG. 1. Feed reservoir 66 may receive the raw feed from external sources through inlet pipe 68 or through inlet pipes 70 and 72 from the feed, rinse and flush outlets of various stations of the machine depending upon the system design. Similarly, rinse inlets and flush inlets may receive clean water, air, or outputs from previous or successive stations or any other fluid or combination of fluids through pipe 74 or other pipes in accordance with the system design. A detailed flow chart is shown in FIG. 4 to illustrate a specific system design which may be implemented with the magnetic separator.

Although thus far the operation of the magnetic separator has been described in terms of flow directed generally downwardly through the matrix, this is not a necessary limitation of the invention. In certain applications it may be preferable to have the flow directed generally upwardly against the elevation head due to gravity, in which case the use of seals is important.

Figure 5:
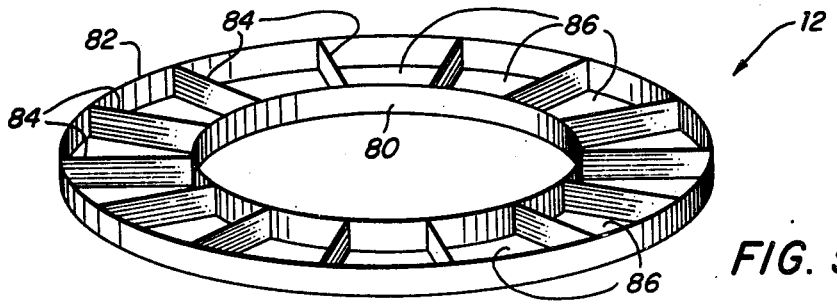
FIG. 5 is a diagrammatic, axonometric view of the matrix device.

Matrix device 12, FIG. 5, may be formed with an inner peripheral member 80 connected to an outer peripheral member 82 by means of walls 84 between which, in compartments 86, is located the matrix medium such as steel wool, steel balls, expanded metal, or the like, here omitted for clarity. In a machine such as machine 10, FIG. 1, where the matrix device 12 is an annulus, members 80 and 82 are circular rings and the matrix device is constructed as a single continuous annulus.

Figure 3:
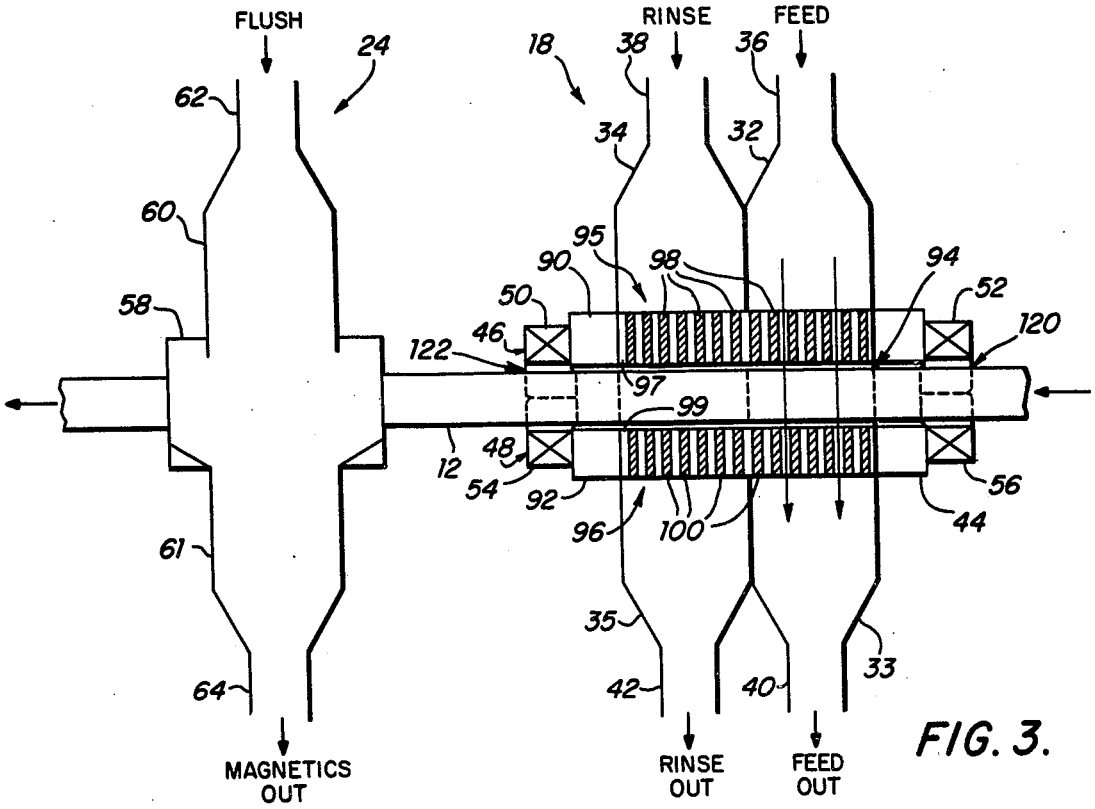
FIG. 3 is an enlarged diagrammatic sectional side view of the feed station and the flush station of the separator shown in FIG. 1.

Each feed station as exemplified by feed station 18, FIG. 3, includes a pole unit including a first ferromagnetic pole member 90 and a second ferromagnetic pole member 92 aligned with the first pole 90 and a working magnetic field volume 94 formed between pole members 90 and 92. Located in each pole member 90 and 92 are inlet means 95 and outlet means 96 for permitting the introduction and removal of feed or rinse or any other fluid to the portion of matrix device 12 presently within the working volume 94. Surfaces 97, 99 on inlet 95 and outlet 96 cooperate with the seals of this invention as is explained, infra. Inlet means 95 is shown specifically as a plurality of ferromagnetic members or plates 98 spaced from each other in the direction of motion of matrix device 12 and extending transversely across the path of matrix device 12. Outlet means 96 is similarly formed from ferromagnetic members or plates 100 similarly spaced from each other in the direction of motion of matrix device 12 and transverse to the direction of motion of matrix device 12. Plates 98 and 100 are arranged to direct the flow of the fluid in the matrix so that it is parallel to the magnetic field between poles 90 and 92. Following feed station 18 in sequence is flush station 24 in which the housing 58 may include, FIG. 3, simply a box in which the flush liquid entering through inlet 60 may be passing through the portion of the matrix then present in housing 58.

Figure 6A:
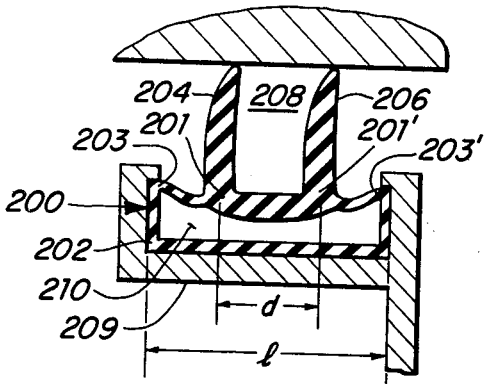
FIG. 6A is a cross-sectional view of an inflatable self-purging seal according to this invention.

A self-purging seal 200, FIG. 6A, according to this invention includes a base portion 202 disposed in retainer 209 and a pair of spaced lip portions 204, 206, which form channel 208. An inflatable passage 210 may be formed in base 202 and may have the pressure therein decreased or increased, as in FIG. 6B, to decrease or increase the sealing pressure at lips 204 and 206.

Figure 6B:
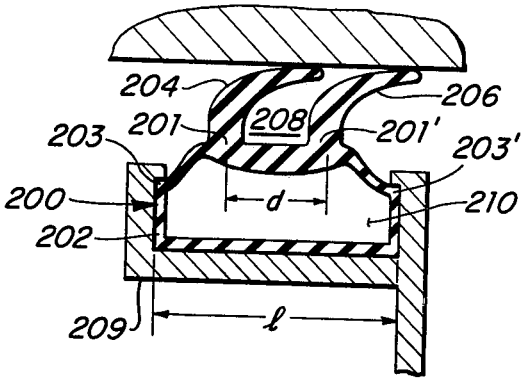
FIG. 6B is a view similar to FIG. 6A with the seal inflated.

Base portion 202 is larger in the lateral dimension l, FIGS. 6A, 6B, than the distance d between the lip portions 204, 206, which are mounted at positions 201, 201', inwardly of outer edges 203, 203', to insure movement of lip portions 204, 206 in response to variations in pressure in base 202.

Figure 7A:
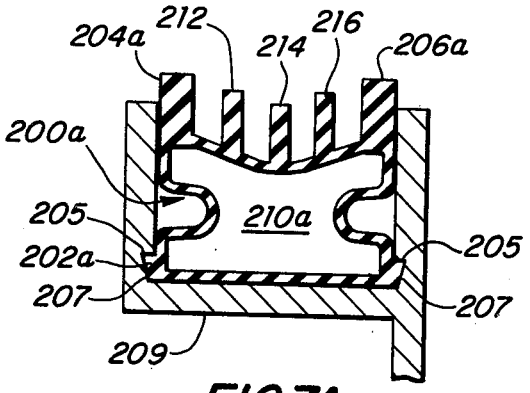
FIG. 7A is a view similar to FIG. 6A illustrating an alternative form of the seal.
Figure 7B:
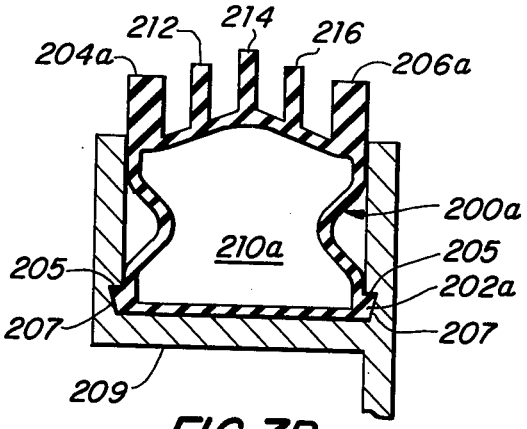
FIG. 7B illustrates the seal of FIG. 7A in its inflated form.

In FIG. 7 and subsequent figures, like parts have been given like numbers accompanied by successive lower case letters. Although in FIGS. 6A and 6B seal 200 has been shown with only two lip portions 204 and 206, this is not a necessary limitation of the invention, for as shown in FIG. 7A, seal **200*a* includes two primary lip portions 204*a* and 206*a* and three secondary lip portions 212, 214, and 216. When the pressure in channel 210*a* is increased, seal 200*a* may take the form shown in FIG. 7B. Some means such as detents 205, FIGS. 7A, B, may be provided which engage with notches 207 in retainer 209** to capture the seals when inflated, but allows them to be easily removed when deflated.

Although the seals of this invention are illustrated herein with a circular or rotary device, that is not a necessary limitation of the invention: the matrix device may assume a number of different geometries. If it is generally linear the seals are disposed along the longitudinal edge. If it is generally circular the longitudinal edge corresponds to the circumferential edge.

Figure 8:
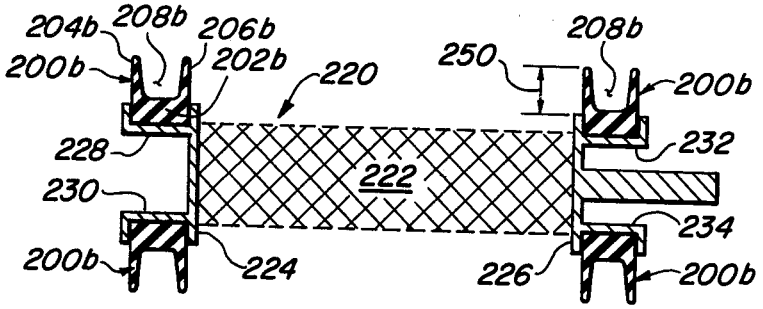
FIG. 8 is a schematic cross-sectional view showing the installation of solid, non-inflatable seals according to this invention on a matrix device.

Typically, the seal according to this invention is used in a set of four, where there is one seal **200*b*, FIG. 8, disposed along each of the upper longitudinal sections and each of the lower longitudinal sections of a matrix device 220 which may be linear, not circular, and which includes a matrix 222 and at least two longitudinal sides 224 and 226, that carry retainers or mountings 228, 230, 232, and 234, for holding seals 200*b*. Although in FIGS. 6 and 7 seals 200 and 200*a* are shown with hollow bases containing inflatable passages, this is not a necessary limitation of the invention: seals 200*b* in FIG. 8 include lip portions 204*b* and 206*b* which are integral with and are formed of the same material as solid base portion 202*b***.

The seals are disposed along the longitudinal section or edge of the matrix device, which typically includes the two major edges or sides in a generally straight or linear matrix device and the inner and outer circumferential edges in a circular device. The location of a seal, specifically seal 200, is shown in greater detail in FIG. 9, where it is mounted in a retainer **228*a* fixed to wall 224*a* of a matrix device 220*a*, which includes transverse walls 236 forming compartments in which the matrices 222*a* are placed. Means such as inlet 240 in passage 210 of seal 200 is used to inflate and deflate passage 210 via valve 242**.

There may be means on retainer **228*a* (see 205, 207, 209, FIGS. 6 and 7) such that seal 200 is captured when passage 210 is inflated, but seal 200 is easily removed when passage 210** is deflated.

Figure 10:
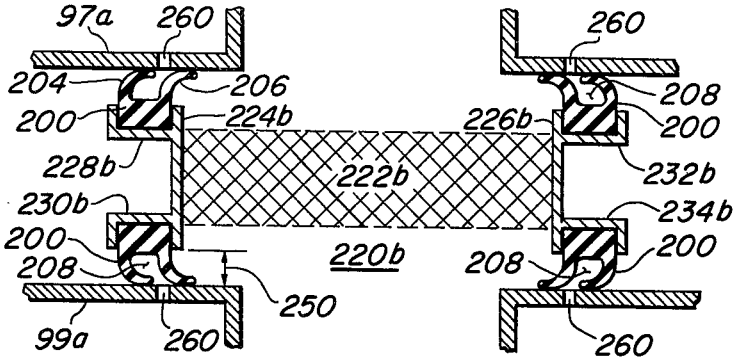
FIG. 10 is a view similar to FIG. 8 with the matrix device installed between sealing surfaces with the seals disposed in operating position.

In operation, seals such as seals 200, FIG. 10, mounted in retainers **228*b*, 230*b*, 232*b*, and 234*b*, carried by sections or walls 224*b* and 226*b* of matrix device 220*b*, are disposed so that their lip portions 204, 206, are bent inwardly toward matrix 222*b* as they contact sealing surfaces 97*a*, 99*a*. To maintain lip portions 204, 206 in this flexed position, the gap 250 between the matrix device and its associated sealing surface is less than the extent of the seal 200 extending beyond the matrix device. Means are provided, such as inlets 260, whereby purging fluid is introduced to channel 208 of seal 200**.

Figure 11:
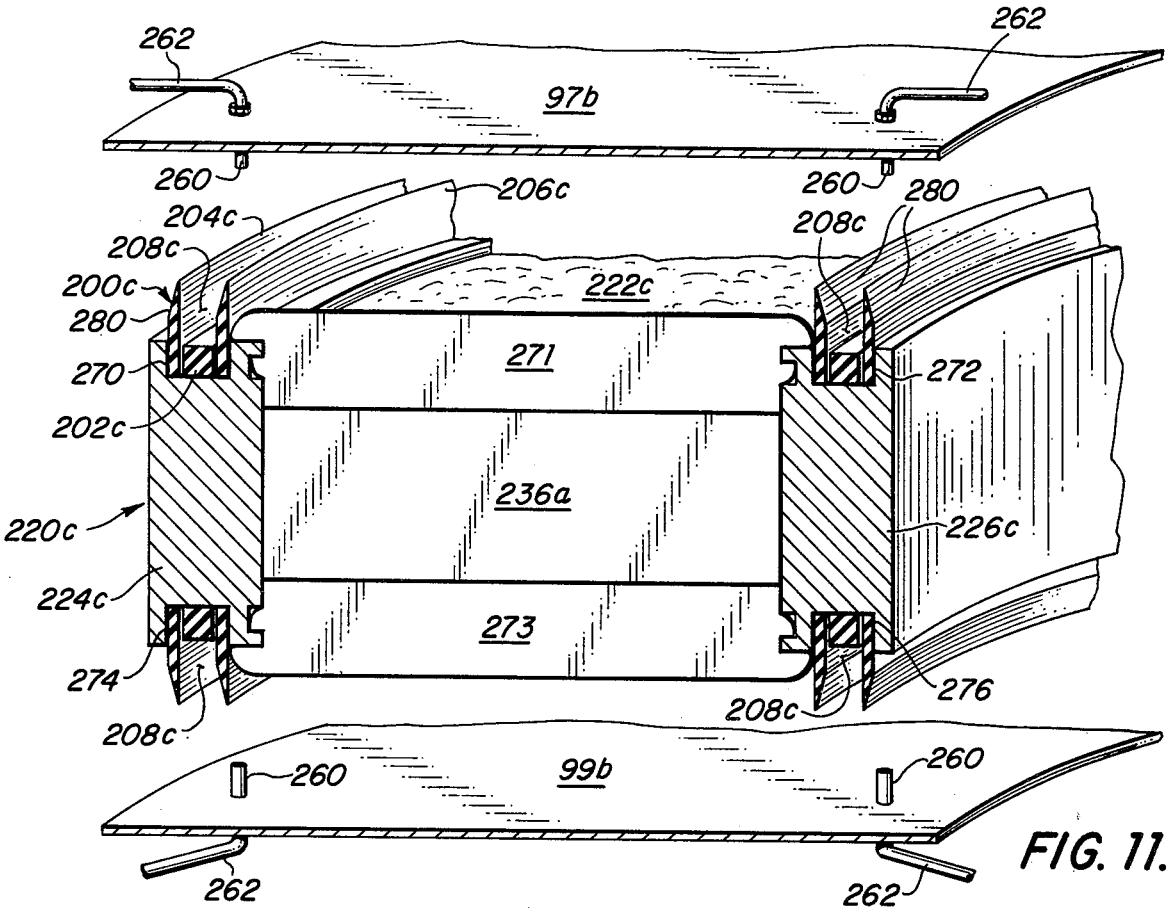
FIG. 11 is an exploded, axonometric view with portions broken away showing a preferred form of seal according to this invention.

In one preferred embodiment, matrix device **220*c*, FIG. 11, includes side walls 224*c* and 226*c*, which contain grooves 270, 272, 274, 276, in which seals 200*c* are located. Between longitudinal or circumferential walls 224*c* and 226*c* extend a number of transverse or radial walls 236*a* which separate the matrices 222*c* into a number of compartments. At the upper and lower edges of transverse walls 236*a* are transverse seals 271 and 273. Each seal 200*c* includes a solid base portion 202*c* which extends longitudinally along the circumferential edge of matrix device 222*c*. Seal 200*c* also includes a pair of lip portions 204*c* and 206*c*, which also extend longitudinally along the circumferential edge of matrix device 222*c* and are spaced from each other to provide therebetween a passage 208*c*. Sealing surfaces 97*b* and 99*b* provide means such as inlets 260 fed by conduits 262 for providing purging fluid to passage 208*c*. In this embodiment base 202*c* and lips 204*c* and 206*c* are separate pieces but are all made of a resilient substance such as rubber. In addition, each of lip portions 204*c* and 206*c* includes a chamfer 280** on its outer portion facing away from the matrix, which facilitates the bending inwardly toward the matrix of the lip portions.

Figure 12:
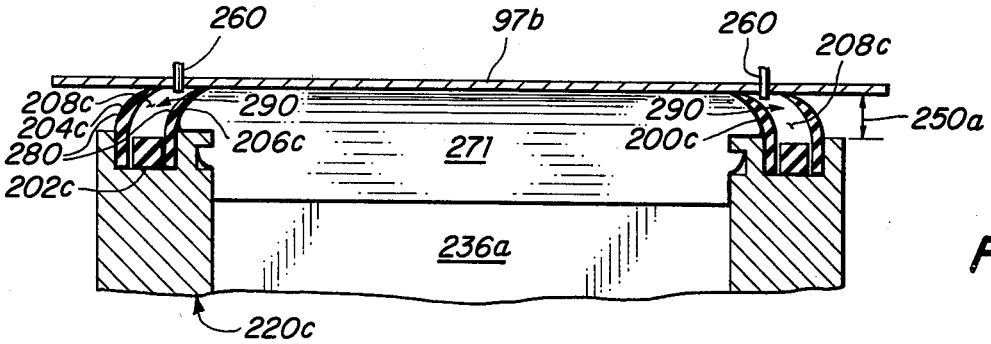
FIG. 12 is an enlarged detailed view of a portion of the seal in FIG. 11 in an operative position.

In operation, with sealing surface **97*b*, FIG. 12, spaced from matrix device 220*c* by a distance, gap 250*a*, which is less than the extent of seal 200*c* above matrix device 220*c*, seals 200*c* flex inwardly and grip transverse seal 271 as the matrix moves, and purging fluid is fed through inlet means 260 to passages 208*c* which, in conjunction with sealing surface 97*d*, form a closed chamber 290** capable of receiving and holding the purging fluid at pressures the same as or preferably with a differential over the pressure in the matrix and outside the matrix.

Because of the inward curve of portions 204c and 206c, an increase in pressure in the self-purging fluid in chambers 290 more easily flexes the inner lip portions than the outer lip portions so that the purging fluid escapes primarily into the matrix and cleans the inner lip portion, which is part of the seal that is most apt to become contaminated by abrasive materials contained in the feed.

Figure 13:
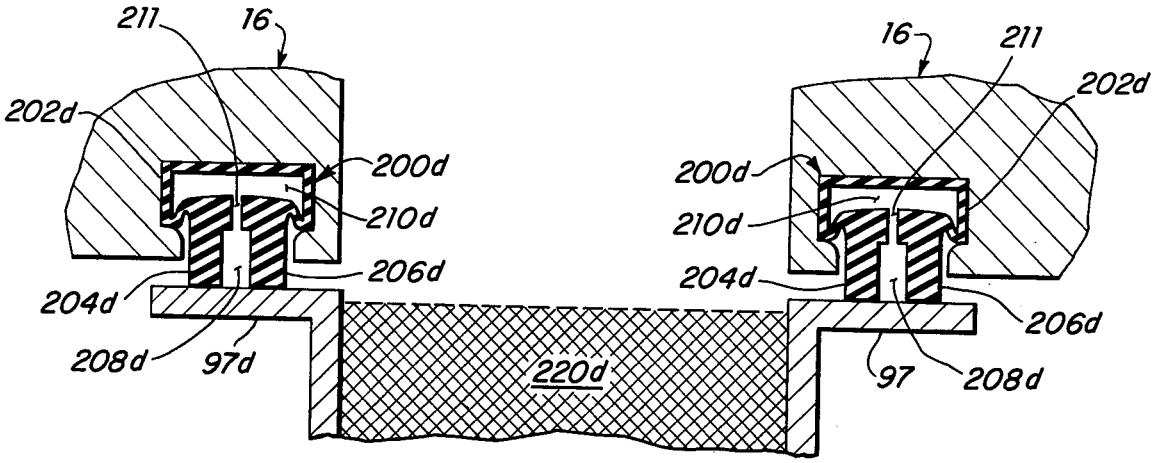
FIG. 13 is a diagrammatic sectional view of a portion of a matrix and processing device or station with the seals on the station and sealing surface on the matrix device.

Although the seals 200 have been shown attached to and moving with the matrix device 220, and the sealing surfaces 97, 99 are attached to a stationary feed station, this is not a limitation of the invention. As illustrated in FIG. 13, seals 200d may be attached to a stationary feed station 16 or flush station 24. The sealing surfaces 97, 99 are then attached to and move with the matrix device 220d.

When seal 200d is stationary it may still have any of the constructions illustrated earlier, or it may conveniently have the construction illustrated in FIG. 13, where the inflating fluid is allowed to pass through passages 211 in base 202d of seal 200d to serve also as the purge fluid.

Figure 9:
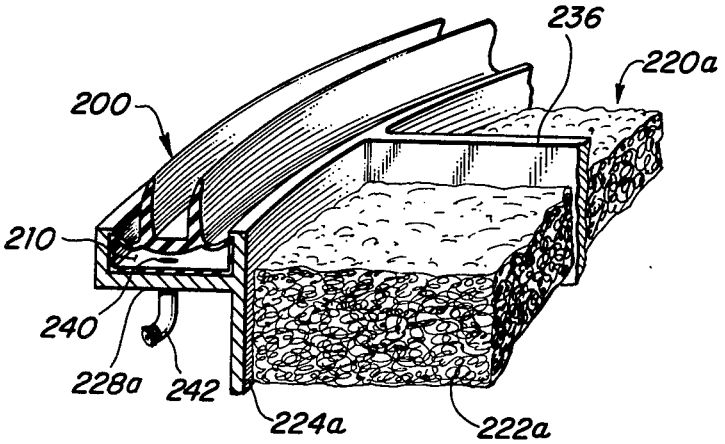
FIG. 9 is an enlarged detailed axonometric view showing a seal on a matrix device.

The seal construction of FIG. 13 can also be used with the seal moving. However, when an inflatable seal is used on the moving matrix means, it is preferable to inflate the seal with air or some other compressable medium and seal it off via a valve, as illustrated in FIG. 9. This valve is conveniently of the type commonly found on automobile and other tires, and allows occasional changes in air pressure as may be called for. With the seal inflated and so sealed, the purging fluid is conveniently introduced via the stationary sealing surface as in FIG. 10.

Figure 14:
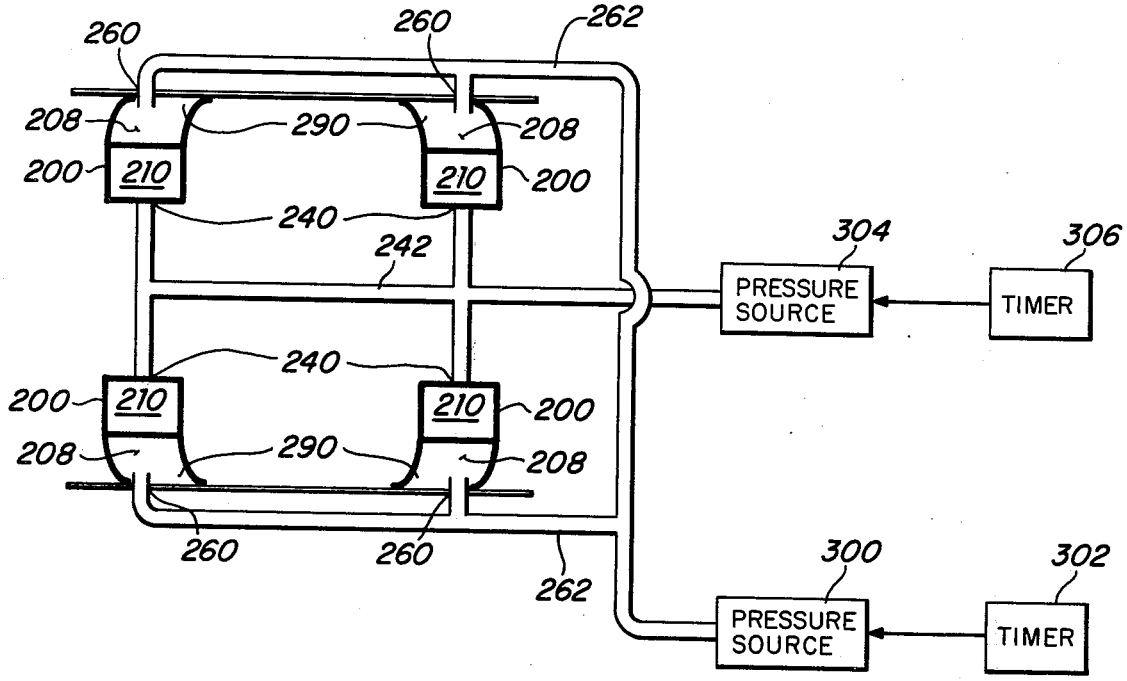
FIG. 14 is a schematic view of a system for controlling flow of self-purging fluid to the self-purging chambers of the seal and for pressurizing inflatable seals.

Flow of purging fluid from chamber 290 may be increased and decreased by increasing and decreasing the pressure of the purging fluid supplied to chambers 290, for example by controlling the pressure through pressure source 300, FIG. 14, and the time variations in pressure by timer 302. In addition, the flow of purge fluid can be controlled in an inflatable seal 200 by increasing and decreasing the pressure in passage 210 through pressure source 304, which can be varied over time by a timer 306.

Although the seals of this invention have been described in terms of their self-purging action, it is recognized that the purge fluid also usually provides lubrication between the seal lips and the sealing surface, making the operation of the magnetic separator smoother and reducing the force required to move the matrix device.

Other embodiments will occur to those skilled in the art and are within the following claims:

What is claimed is:

1. In a moving matrix magnetic separator in which a matrix device moves relative to a processing device and a seal assembly seals a longitudinal section of the matrix device to an associated processing device, said seal assembly including a sealing surface on one of the devices and a seal on the other, the improvement comprising said seal including a base portion extending generally longitudinally to the direction of motion of the matrix device and having an inflatable passage extending longitudinally therethrough, first and second salient, resilient lip portions extending from said base portion toward an associated sealing surface in the gap between the matrix device and processing device, and means for inflating and deflating said passage to control the contact pressure between said lip portions and said associated sealing surface, said lip portions extending generally longitudinally to the direction of motion of the matrix device and spaced from each other transversely to the direction of motion of said matrix device and forming a channel therebetween; a pressurized purge fluid chamber formed by said channel and the associated sealing surface; and means for suppling purging fluid to the purge fluid chamber formed by said channel and lip portions with the associated sealing surface.

2. The seal of claim 1 in which said inflatable passage and said channel are interconnected and said purge fluid is used for inflating said passage.

3. In a moving matrix magnetic separator in which a matrix device moves relative to a processing device and a seal assembly seals a longitudinal section of the matrix device to an associated processing device, said seal assembly incuding a sealing surface on one of the devices and a seal on the other, the improvement comprising said seal including a base portion extending generally longitudinally to the direction of motion of the matrix device; and inner and outer salient, resilient lip portions extending from said base portion toward an associated sealing surface in the gap between the matrix device and processing device, said lip portions extending generally longitudinally to the direction of motion of the matrix device and spaced from each other transversely to the direction of motion of said matrix device and forming a channel therebetween; a pressurized purge fluid chamber formed by said channel and the associated sealing surface; and means for supplying purging fluid to the purge fluid chamber formed by said channel and lip portions with the associated sealing surface, the height of at least said inner lip portion being greater than said gap between said matrix device and said processing device and said inner lip portion being bent inwardly by said associated sealing surface toward said matrix to that an increase in pressure in said purge fluid chamber causes said inner lip portion to easily flex and the purging fluid to escape into the matrix and clean said inner lip portion of abrasive particles.

4. The seal of claim 1 in which said means for supplying purging fluid is mounted to said sealing surface.

5. The seal of claim 1 in which each said lip portion is chamfered on its outer portion facing away from the matrix to taper toward the sealing surface, to facilitate the bending of said lip portions inwardly toward said matrix.

6. The seal of claim 1 in which said seal is carried by said matrix device and said sealing surface is mounted on said processing device.

7. The seal of claim 1 in which said sealing surface is carried by said matrix device and said seal is mounted on said processing device.

8. The seal of claim 1 in which said base portion is larger in the lateral dimension than the distance between said lip portions and said lip portions are mounted inward of the lateral edges of said base portion.

9. The seal of claim 1 in which said processing device is a feed station including first and second ferromagnetic pole members spaced apart to form a working magnetic field volume through which said matrix device moves.

10. In a moving matrix magnetic separator in which a matrix device moves relative to a processing device and a seal assembly including a seal surface fixed to said processing device and a seal fixed to said matrix device for sealing a longitudinal section of the matrix device to an associated sealing surface, the improvement comprising said seal including a base portion extending generally longitudinally to the direction of motion of the matrix device; and inner and outer salient, resilient lip portions extending from said base portion toward an associated sealing surface in the gap between the matrix device and sealing surface, said lip portions extending generally longitudinally to the direction of motion of the matrix device and spaced from each other transversely to the direction of motion of said matrix device and forming a channel therebetween; a pressurized purge fluid chamber formed by said channel and the associated sealing surface; and means for supplying purging fluid to the purge fluid chamber formed by said channel and lip portions with the associated sealing surface, the height of said lip portions being greater than said gap between said matrix device and said sealing surface and said lip portions being bent inwardly by said associated sealing surface toward said matrix so that an increase in pressure in said purge fluid chamber causes said inner lip portion to flex more easily than said outer lip portion and permit the purging fluid to escape primarily into the matrix and clean said inner lip portion of abrasive particles.

11. In a magnetic separator in which a multicompartmented annular matrix device has radially extending walls dividing it into compartments and is rotated about a vertical axis relative to a processing device and seal assemblies adjacent the upper and lower edges at the radially inner periphery and at the radially outer periphery of the matrix device seal said matrix device to said processing device, each said seal assembly including a sealing surface on one of the devices and a seal on the other, the improvement comprising said seal including an annular base portion and inner and outer annular salient, resilient lip portions extending from said base portion toward an associated sealing surface in the gap between the matrix device and said processing device, said lip portions being radially spaced from each other and forming an annular channel therebetween; a pressurized purge fluid chamber formed by said channel and the associated sealing surface; and means for supplying purging fluid to the purge fluid chamber formed by said channel and lip portions with the associated sealing surface, the height of said lip portions being greater than said gap between said matrix device and said sealing surface and said lip portions being bent radially by said associated sealing surface toward said matrix so that an increase in pressure in said purge fluid chamber causes said inner lip portion to flex more easily than said outer lip portion and permit the purging fluid to escape primarily into the matrix and clean abrasive particles from said inner lip portion of said seal assembly.

12. In a magnetic separator in accordance with claim 11 wherein said matrix device has radially extending transverse seals at the upper and lower edges of said radially extending walls and said bent over inner lip portions grip said transverse seals.

* * * * *